United States Patent [19]

Watkins

[11] Patent Number: 4,841,886

[45] Date of Patent: Jun. 27, 1989

[54] NEEDLE PLATE FOR DOUBLE NEEDLE BAR LOOP PILE TUFTING APPARATUS

[75] Inventor: Charles W. Watkins, Ooltewah, Tenn.

[73] Assignee: Tuftco Corporation, Chattanooga, Tenn.

[21] Appl. No.: 270,241

[22] Filed: Nov. 14, 1988

[51] Int. Cl.[4] ..... D05C 15/08

[52] U.S. Cl. ..... 112/80.3; 112/80.41; 112/80.52

[58] Field of Search ..... 112/80.52, 80.3, 80.41

[56] References Cited

U.S. PATENT DOCUMENTS

| | | | |
|---|---|---|---|
| 3,398,708 | 8/1968 | Card | 112/80.3 |
| 4,366,761 | 1/1983 | Card | 112/80.41 |
| 4,368,679 | 1/1983 | Hash | 112/80.52 |
| 4,800,828 | 1/1989 | Watkins | 112/80.41 |

*Primary Examiner*—Ronald Feldbaum
*Attorney, Agent, or Firm*—Harrington A. Lackey

[57] ABSTRACT

A needle plate member for a multiple needle loop pile tufting machine including double needle bars supporting transverse rows of front and rear needles in which at least one row of needles has a narrow gauge. Finger members or needle plate fingers project rearward from the needle plate and extend rearward beyond the rear needles. The transverse spacing between each pair of needle plate fingers is equal to twice the needle gauge of the needles having the narrow gauge. The wider gauge or transverse spacing of the needle plate fingers permits the fingers to extend rearwardly through both front and rear transverse rows of needles to adequately support the base fabric moving through the machine and penetrated by both sets of needles, as well as guiding the front loops past the rear needles to minimize tagging.

9 Claims, 3 Drawing Sheets

NEEDLE PLATE FOR DOUBLE NEEDLE BAR LOOP PILE TUFTING APPARATUS

BACKGROUND OF THE INVENTION

This invention relates to a needle plate for a double needle bar loop pile tufting machine, and more particularly to a needle plate having needle plate fingers adequate to support the base fabric for penetration by both rows of needles.

In a conventional multiple needle tufting machine, the needle plate is provided with a plurality of uniformly spaced straight fingers extending from one edge of the needle plate in the direction of fabric feed, or rearward, so that each finger extends between and beyond an adjacent pair of needles. These fingers are adapted to provide a support for the portion of the base fabric in the path of the needles and are spaced to permit free reciprocation of the needles between the fingers. In a conventional multiple needle tufting machine, the needle plate fingers are uniformly spaced at the same gauge as the needles.

Furthermore, a conventional needle plate finger has a rectangular cross-section, with its short dimension transverse, and its long dimension vertical. Thus, each cantilevered needle plate finger has substantial depth to provide sufficient strength to support the base fabric as the fabric is penetrated by the needles. Moreover, the short transverse dimension of each needle plate finger is desirable so that the needles can be spaced closer together to achieve finer gauges.

The above described conventional needle plates are quite adequate for supporting base fabric moving through a multiple needle tufting machine in which the needles are in-line, that is, in a single transverse row or line, and also where the needle gauge is not too narrow or fine.

It is well established in the art of tufting to reduce the needle gauge by staggering the needles, that is, to position a transverse row of rear needles behind a transverse row of front needles and to offset transversely the rear needles relative to the front needles. Various needle plates have been designed particularly for supporting the base fabric as it moves through a staggered needle machine. Examples of such needle plates are shown in the following U.S. Pat. Nos.

2,975,736, J. L. Card, Mar. 21, 1961
2,976,829, R. T. Card, Mar. 28, 1961
3,398,708, R. T. Card, Aug. 27, 1968
3,641,956, Ownbey, Feb. 15, 1972
4,503,787, Watkins, Mar. 12, 1985
4,658,739, Watkins, Apr. 21, 1987

The following U.S. patents disclose multiple needle tufting machines in which the needles in the front row and the needles in the back row are longitudinally aligned: U.S. Pat. Nos.

2,889,791, Fedevich, June 9, 1959
3,025,807, Gebert, Mar. 20, 1962

In both of the above patents, the base fabric is supported over a long span beneath two transverse rows of needles by a plurality of transversely spaced elongated, straight grating bars, which are supported at both their front and rear ends and in which a grating bar extends between each pair of adjacent needles.

In all of the above patents, it will be noted, that there is a needle plate finger extending between every adjacent pair of needles. Thus, the thickness or transverse dimension of each needle finger limits the proximity of spacing of the needles, and therefore the needle gauge.

In the applicant's U.S. patent application Ser. No. 150,759, filed Feb. 1, 1988, for "DOUBLE NEEDLE BAR LOOP PILE TUFTING APPARATUS", FIGS. 10 and 11 disclose transverse rows of front and rear needles and hook bars. In this apparatus a conventional needle plate having relatively short fingers is utilized for supporting the base fabric beneath the front needles, but separate needle plate fingers are affixed to the rear hooks for supporting the base fabric as it passes beneath the rear needles. Although these needle plate fingers affixed to the rear hooks have worked satisfactorily, nevertheless, there are some disadvantages. In order to vary the pile height in a conventional tufting machine, it is necessary to raise and lower the bedplate supporting the needle plate in order to vary the distance between the plane of the base fabric and the bottom of the looper, which determines the pile height, unless back-robbing is involved. Therefore, when the needle plate is utilized only for the front needles, as disclosed in FIG. 10 of the Watkins application Ser. No. 150,759, the rear needle plate fingers affixed to their corresponding rear hooks predetermines the pile height and permits no means of varying the pile height. Moreover, because of the longitudinal spacing between the front needle plate fingers and the rear moving needle plate fingers, the rear fingers occasionally interfere with the passage of the front loops as they move rearwardly with the base fabric.

SUMMARY OF THE INVENTION

It is therefore an object of this invention to provide in a multiple needle double needle bar tufting machine an improved needle plate which will adequately support the base fabric as it moves between both the front and rear needles of a loop pile tufting machine, and yet permit narrower gauges, transverse needle bar shifting, and variation in the pile height.

A further object of this invention is to provide a needle plate for a double needle bar loop pile tufting apparatus in which the needle plate is provided with a plurality of long needle plate fingers or finger members which project continuously rearwardly beneath the entire portion of the base fabric passing beneath both the front and rear needles to control and guide the formed loops and to prevent tagging, particularly the front loops.

Another object of this invention is to provide a needle plate having a plurality of elongated needle plate fingers which extend between both the front needles and the rear needles and in which the transverse spacing of the fingers is equal to twice the needle gauge of the narrowest needle gauge in either or both the front and rear needle rows.

Another object of this invention is to provide a needle plate for a double needle bar loop pile tufting apparatus in which the needle gauge of the front needles and the rear needles may be the same or either row may have a needle gauge narrower than the other row, and the needle plate includes fingers which extend between the needles in both rows so that the needles having the narrower gauge are arranged in pairs between each pair of needle plate fingers.

Another object of this invention is to provide a needle plate finger for a double needle bar loop pile tufting machine in which the rear needles are staggered relative to the front needles and the needle plate is provided with elongated fingers which extend between alternate pairs of needles of the more narrow gauge, but extend between the needles of both rows and has a slightly bent or offset rear portion for passing near each staggered rear needle.

Another object of this invention is to provide a double needle bar loop pile tufting apparatus incorporating a needle having needle plate fingers extending between the in both the front and rear transverse rows and which will permit adequate base fabric support even when the needles in either or both rows are transversely shifted.

A further object of this invention is to provide a needle plate for a double needle bar loop pile tufting apparatus in which the front needles are one-half the gauge of the rear needles and the needle plate fingers project between alternate pairs of front needles and closely adjacent to each corresponding rear needle.

DESCRIPTION OF THE PREFERRED EMBODIMENTS

Figure 1:
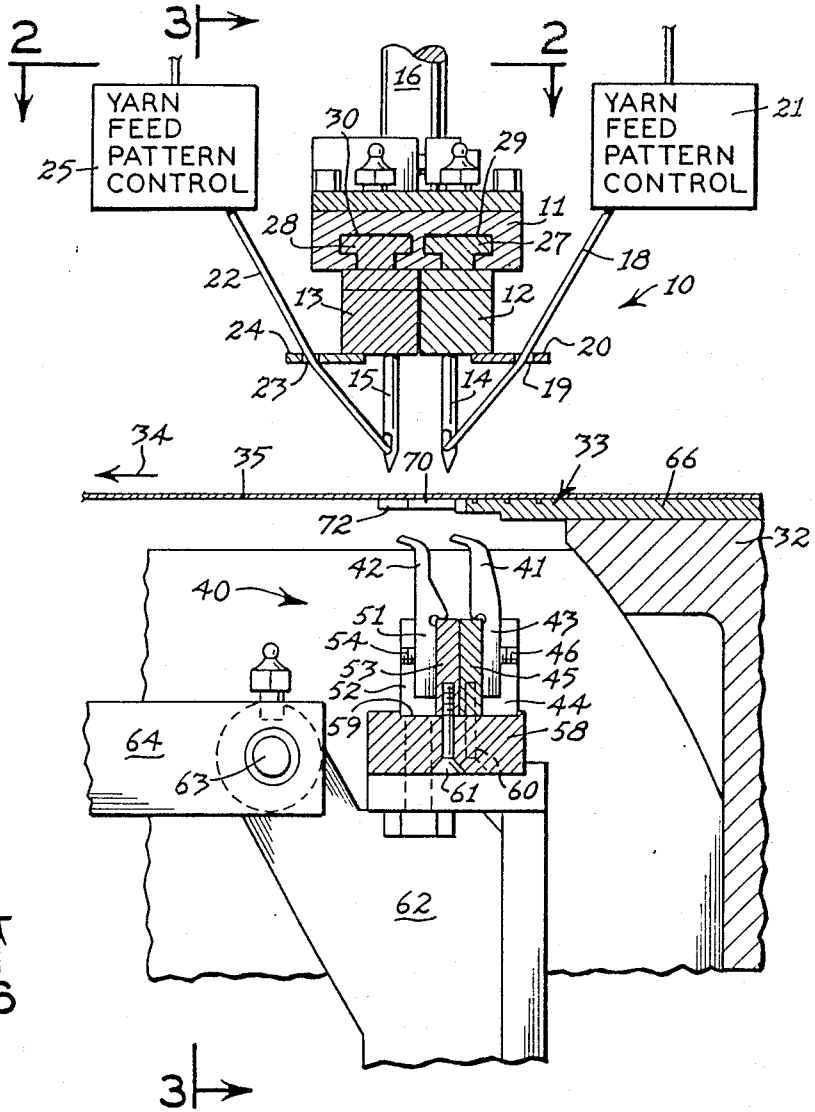
FIG. 1 is a fragmentary sectional elevational view of a portion of a multiple needle tufting machine incorporating this invention, and disclosing the needles and hooks in their retracted, inoperative positions.

Referring now to the drawings in more detail, FIG. 1 discloses a multiple needle loop pile tufting machine 10 including a plurality of elongated transversely spaced needle bar carriers 11 supporting a front needle bar 12 and a rear needle bar 13. The front needle bar 12 supports a row of transversely spaced needles 14, while the rear needle bar 13 supports a row of transversely spaced rear needles 15. Each needle bar carrier is connected to a push rod 16 adapted to be vertically reciprocated by a conventional needle drive mechanism, not shown.

Front yarns 18 are supplied to the corresponding front needles 14 through corresponding apertures 19 in the front yarn guide plate 20 from a source of yarn supply, not shown, such as yarn feed rolls, creels, or other known yarn supply means. Preferably the front yarns 18 pass through a yarn feed pattern control mechanism 21, graphically illustrated in FIG. 1, adapted to back-rob individual front yarns 18 in accordance with a predetermined pattern. Any one of several pattern control mechanisms may be incorporated in the mechanism 21, such as those disclosed in U.S. Pat. Nos. 2,782,905 and 2,935,037.

In the same manner, rear yarns 22 are supplied to the corresponding rear needles 15 through corresponding apertures 23 in the rear yarn guide plate 24 from another source of supply for the yarns, not shown. Also in a preferred form of the invention, the rear yarns 22 are fed through a separate yarn feed pattern control mechanism 25, which may be independent of the yarn feed pattern control mechanism 21, in order to back-rob individual rear yarns 22 in order to produce loop pile loops of different heights or depths, depending upon the are-determined pattern incorporated in the rear pattern control mechanism 25.

Figure 2:
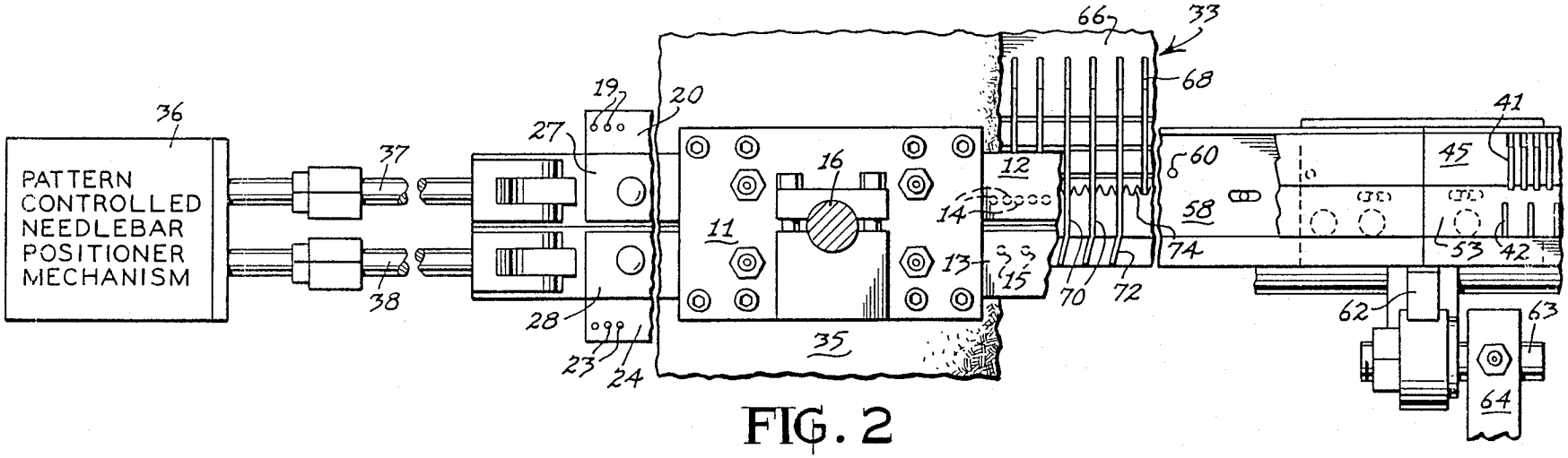
FIG. 2 is a fragmentary plan sectional view taken along the line 2—2 of FIG. 1, with portions broken away.

The front needle bar 12 and the rear needle bar 13 are preferably slidably mounted within the needle bar carriers 11 by the corresponding front and rear T-shaped slide plates 27 and 28 transversely slidably carried or mounted within the guideway channels 29 and 30. Each needle bar 12 and 13 may be transversely or laterally shifted independently of each other by appropriate pattern control means in a well known manner, such as the pattern controlled needle bar positioner mechanism 36 (FIG. 2), through corresponding push rods 37 and 38 connected to the respective front needle bar 12 and rear needle bar 13.

Supported upon the bed frame 32 is a needle plate or needle plate member 33 made in accordance with this invention to support a base fabric 35 for longitudinal rearward movement through the machine 10 in the direction of the arrow 34 (FIG. 1).

The needle drive mechanism, not shown, is designed to actuate the push rod 16 to vertically reciprocate the pair of needle bars 12 and 13 to cause the front and rear needles 14 and 15, respectively, to simultaneously penetrate the base fabric 35 far enough to carry the respective yarns 18 and 22 through the base fabric 35 to form loops therein. After the loops are formed, the needles 14 and 15 are vertically withdrawn to their elevated, retracted positions, disclosed in FIGS. 1 and 3.

The looper apparatus 40 made in accordance with this invention includes a plurality of transversely spaced front loop pile hooks 41 and a plurality of transversely spaced rear loop pile hooks 42, there being one front loop pile hook 41 for each front needle 14, and one rear loop pile hook 42 for each rear needle 15.

Each front loop pile hook 41 is provided with a shank 43 received in a corresponding slot 44 in a transverse front hook bar 45. The front hooks are secured in the front hook bar slots 44 by corresponding set screws 46. The front loop pile hooks 41 have the same transverse spacing or gauge as the front needles 14 and are so arranged that the bill 47 of each front hook 41 crosses and engages corresponding front needle 14 when the front needle 14 is in its lowermost position, in a well known manner, to seize the yarn 18 and form a front loop 48 therein (FIG. 4). the bills 47 of the front hooks 41 point rearward in the direction of the fabric feed in the conventional manner of loop pile hooks.

Figure 4:
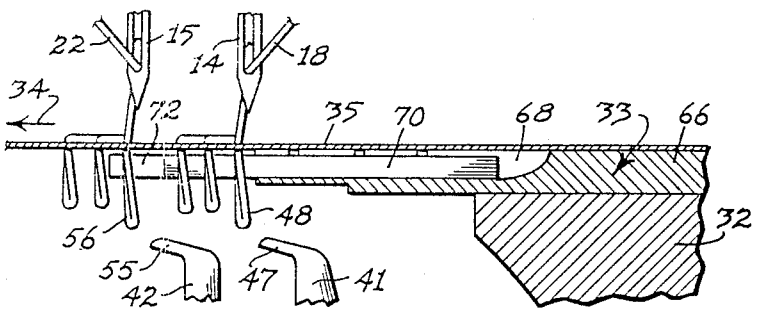
FIG. 4 is an enlarged fragmentary sectional elevation taken along the line 4—4 of FIG. 3.
Figure 6:
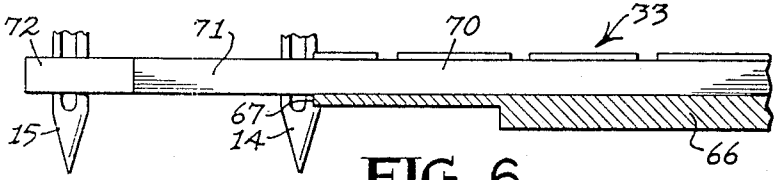
FIG. 6 is a fragmentary sectional elevation taken along the line 6—6 of FIG. 5.

In a similar manner, each of the rear loop pile hooks 42 is provided with a shank 51 received in a corresponding vertical slot 52 in the rear hook bar 53. Each of the shanks 51 is retained in its corresponding slot 52 by a corresponding set screw 54. The rear hooks 42 have the same transverse spacing or gauge as the rear needles 15 and are so arranged that the bill 51 of each hook 42 is adapted to cross and engage its corresponding rear needle 15 when the rear needle 15 is in its lowermost position in a well known manner, to seize the yarn 22 and form a rear loop 56 therein (FIG. 4). The bills 55 of the rear loop pile hooks 42 point rearward in the same direction as the bills 47 of the front loop pile hooks 41.

The front hook bar 45 and the rear hook bar 53 may be independently mounted to extend longitudinally, but transversely of the direction of fabric feed 34, in an elongated hook mounting bar 58. The rear hook bar 53 may be supported for independent slidable movement longitudinally of the hook mounting bar 58 and parallel to the front hook bar 45, in the same manner as disclosed in the pending application Ser. No. 150,759.

Each of the hook bars 45 and 53 may be adjustably secured within the transverse recess 59 of the mounting bar 58 by a plurality of bolts 60 and 61 extending upwardly through the mounting bar 58 and into corresponding threaded holes within the hook bars 45 and 53. The transverse hook mounting bar 58 is fixed to the upper end of a conventional rocker arm 62 which is pivotally connected by a pivot pin 63 to the link bar 64, for connection to a jack shaft, not shown, for reciprocation of the hook mounting bar 58 in a well known manner, such as disclosed in pending application Ser. No. 150,759.

The needle plate member 33 made in accordance with this invention includes a-substantially planar support plate 66 secured to the bed plate 32 in a conventional manner and having a transverse rear free edge 67. Received in plurality of longitudinally extending and transversely spaced finger slots 68 area plurality of preferably uniform finger members or needle plate fingers 70. Each of the fingers 70 preferably has a rectangular cross-section having a greater height than thickness or transverse dimension in a manner similar to conventional needle plate fingers.

Each needle plate finger 70 has an elongated, preferably straight shank portion 71 received in a corresponding slot or recess 68 and projecting rearward from the free edge 67 between the front needles 14 and extending toward the rear needles 15. Preferably, the straight shank portion 71 continues into a rear angular offset portion 72 which is bent or otherwise formed to diverge from the longitudinal axis of the straight shank portion 71 to extend closely adjacent to and rearwardly beyond a corresponding rear needle 15, as best disclosed in FIG. 5. Although the rear offset finger portion 72 is disclosed as being a straight portion such as joined to the straight shank portion 71 by a bend or crease 73, nevertheless, each offset portion 72 could be gradually curved from the straight portion 71.

In the embodiment of the machine 10 disclosed in FIGS. 1–6, the front needles 14 are spaced on a relatively narrow uniform needle gauge while the rear needles 15 have a needle gauge twice as great as the needle gauge of the front needles 14. Moreover, FIG. 5 discloses the rear needles 15 located in a staggered relationship to the front needles 14. In other words, each needle 15 is offset transversely so that it is located in a front-to-rear longitudinal line equally spaced between a pair of front needles 14. However, because of the greater gauge of the rear needles 15, each rear needle 15 is located between alternate pair of front needles 14, that is, a pair of front needles 14, in which the needles are different from any other pair of front needles 14.

Figure 5:
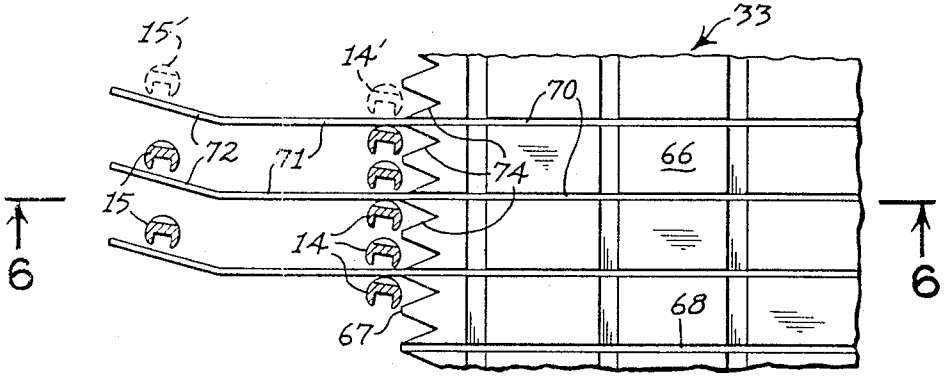
FIG. 5 is an enlarged fragmentary plan view of the needle plate made in accordance with this invention, including the front needles on one-half the gauge of the rear needles, and with the rear needles stepped to the right of the needle plate fingers.

Furthermore, as illustrated in FIG. 5, each of the needle plate fingers 70 extends between every other, or alternate, pair of front needles 14, so that two front needles 14 are located between a pair of adjacent needle plate fingers 70. However, because of the double needle gauge of the rear needles 15, each offset finger portion 72 is located on the left side and closely adjacent a corresponding rear needle 15, so that there is substantial spacing on the right side of each rear needle 15 and the next adjacent offset finger portion 72.

Thus, since only half as many needle plate fingers 70 are needed for the needles in the row having the finest or narrowest needle gauge, the needles and needle plate fingers may be spaced closer together.

Moreover, the needle plate fingers 70 may have sufficient depth and breadth or thickness that they may be projected not only between the front needles 14, but between and rearward of the rear needles 15 to provide sufficient strength for supporting the moving base fabric 35, even when all of the needles 14 and 15 are penetrating the base fabric 35.

Furthermore, it will be noted that in a situation such as that disclosed in FIG. 5 in which the needle gauge of the rear needles 15 is twice the needle gauge of the front needles 14 and the front and rear needles are staggered, the bent or deflected offset finger portion 72 is directed closely adjacent a corresponding rear needle 15 to provide additional support when the corresponding rear needle 15 penetrates the base fabric 35 and descends adjacent the corresponding offset rear finger portion 72. Thus, every needle, both the rear needle 15 and the front needle 14, is located closely adjacent to a finger 70 for maximum support of the base fabric 35.

Figure 7:
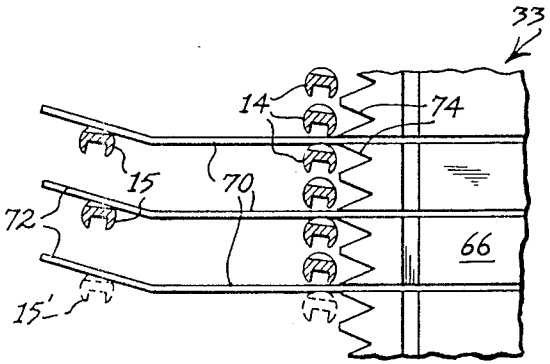
FIG. 7 is a fragmentary plan view similar to FIG. 5, illustrating the rear needles stepped to the left of the needle plate fingers.

FIG. 7 merely discloses the same needle arrangement as FIG. 5, except that the rear needles 15 are located on the left side of the corresponding rear offset finger portion 72. The front needles 14 of FIG. 7 are identical in structure and gauge to the front needles 14 in FIG. 5.

Figure 8:
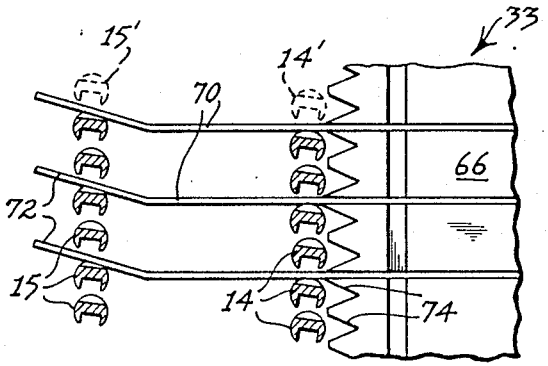
FIG. 8 is a fragmentary plan view similar to FIG. 7 in which both the front and rear needles are of equal narrow gauge.

In FIG. 8, the front needles 14 are identical to those disclosed in FIGS. 5 and 7. However, an additional rear needle 15 has been included so that the needle gauge of the rear needles 15 is identical to the needle gauge of the front needles 14, but the rear needles 15 are still staggered relative to the front needles 14. Thus, between each pair of needle plate fingers 70 are located a pair of front needles 14 and a pair of rear needles 15.

The dashed line positions of the front needles 14' and rear needles 15' in FIGS. 5, 7, and 8, illustrate the position of the next corresponding solid-line needle after such needle has been transversely shifted as a result of the actuation of the pattern control needle bar positioner mechanism 36. Accordingly, the needle plate member 33 made in accordance with this invention including the particularly shaped and spaced needle plate fingers 70 functions equally well for the double needle bar loop pile tufting apparatus, whether both or either needle bar is transversely shifted or whether both needle bars remain in the same transverse position.

In addition to giving improved support to the base fabric 35, the fingers 70 are continuous and the rear portions 72 of the fingers 70 are offset adjacent the rear needles 15 to assist in guiding the loops formed on the front needles 14 to move past and between the rear needles 15, even when the rear needles 15 are on the same narrow gauge as the front needles 14, to prevent tagging of the loops.

By utilizing a type of needle plate member which is mounted on the bed plate 32, with needle plate fingers 70 projecting entirely beneath both rows of needles and beyond the rear needles, the needle plate member 33 is subject to vertical adjustment by conventional means not shown, in order to vary the pile height.

If desired, a plurality of notches 74 may be formed in the rear edge 67 of the support plate 66 to assist in receiving portions of each corresponding front needle 14, in a manner similar to that disclosed in Applicant's prior U.S. Pat. No. 4,503,787.

Figures 3, 9:
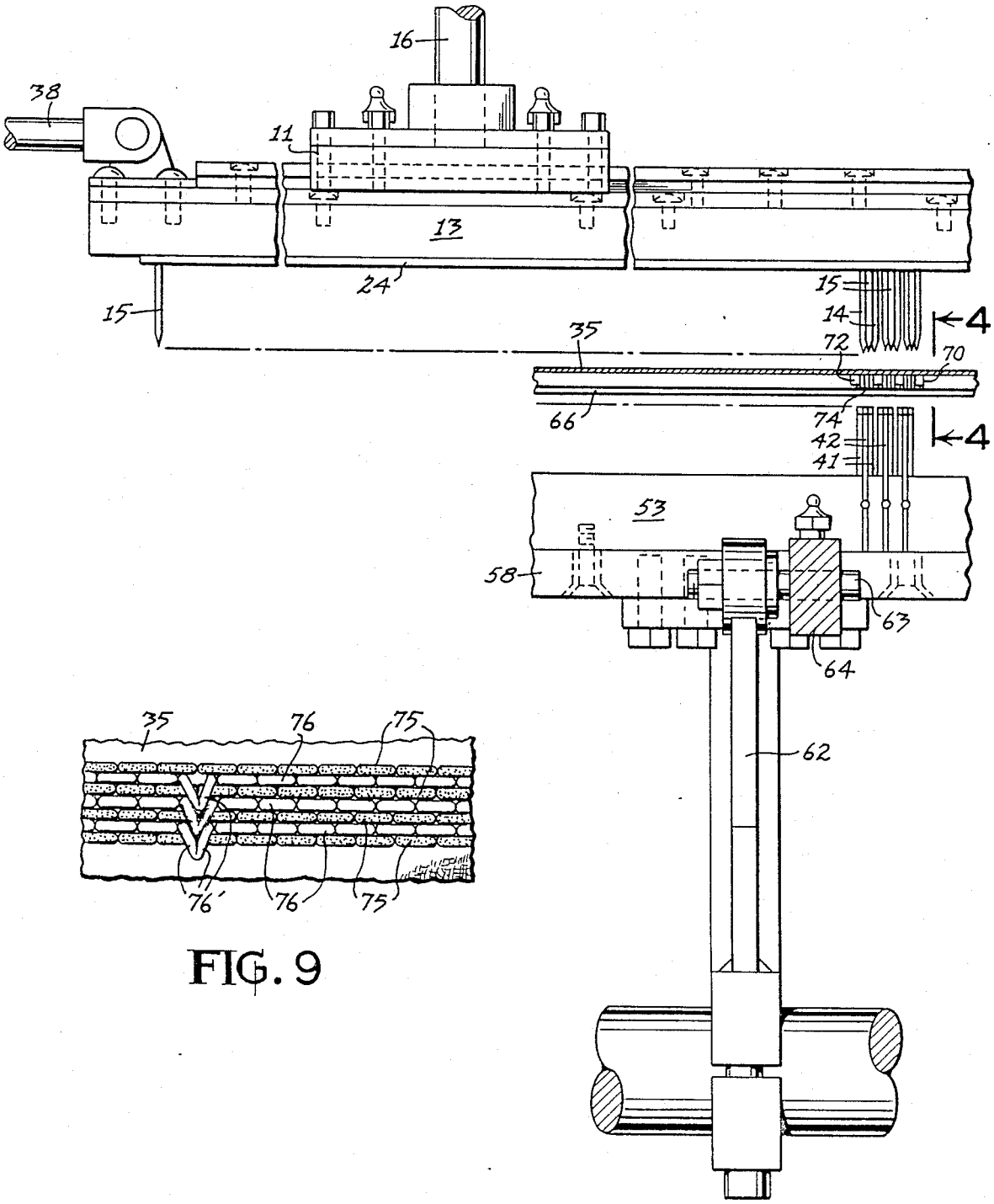
FIG. 3 is a fragmentary rear sectional elevation taken along the line 3—3 of FIG. 1, with portions broken away.
FIG. 9 is a fragmentary plan view of the base fabric in which the stitching is formed on the apparatus disclosed in FIG. 8.

FIG. 9 discloses a back view of a portion of a base fabric 35 in which stitches have been formed by the staggered needles disclosed in FIG. 8. The stippled stitches 75 are the stitches formed by the front needles 14, while the plain or non-stippled stitches 76 are formed in the base fabric 35 by the rear needles 15. The angular stitches 76' illustrate stitches formed by the rear needles 15 shifting left one step and then back to the original line of stitching.

It will now be seen that a needle plate member 33 especially adapted for a multiple needle double needle bar tufting machine 10 has been designed which will adequately support the base fabric 35 as it moves beneath both the front and rear needles. The needle plate member 33 is provided with continuous fingers 70 especially constructed to extend between pairs of front needles 14 and rear needles 15 in a manner which will permit narrow gauge tufting and transverse needle bar shifting for either or both the front and rear needle bars 12 and 13, and still permit vertical adjustment of the needle plate in order to vary the pile height.

The needle plate fingers 70 made in accordance with this invention are strong enough to support the base fabric 35 beneath both the front and rear needles 14 and 15 of a double needle bar in a loop pile tufting machine 10 to permit penetration of all the needles through the base fabric 35, even when arranged in narrow gauges. Moreover, the needle plate fingers 70 made in accordance with this invention are designed to be positioned closely adjacent the path of every needle, whether it is in the front row or the rear row, or whether either or both rows of needles are arranged on a narrow or broader gauge.

What is claimed is:

1. In a multiple needle tufting machine including a front transverse row of reciprocable front needles having a front needle gauge, and a rear transverse row of reciprocable rear needles having a rear needle gauge and spaced rearwardly of said front needles, each front and rear needle having a vertical reciprocable path and being adapted to carry yarn through a base fabric movable longitudinally through the machine, and a looper hook for each needle having a bill for seizing and forming a loop in each yarn carried through the base fabric by the corresponding needle, fabric support means for supporting the base fabric between the needles and the looper hooks, comprising:

(a) a needle plate having a longitudinal dimension and a transverse dimension and a free transverse edge portion, (b) means supporting said needle plate so that said free edge portion extends transversely of the machine and closely adjacent the reciprocable paths of the transverse row of said front needles, (c) a plurality of finger members mounted in said needle plate, each finger member projecting rearward from said free edge portion, (d) each said finger member terminating in a rear end behind said rear transverse row of rear needles, (e) each pair of said finger members having a uniform transverse spacing equal to twice the needle gauge of said transverse row of needles having the narrower needle gauge of both said transverse rows, and (f) said finger members projecting rearwardly between every other pair of needles having said narrower needle gauge, said needle fingers extending rearwardly between the needles in said other transverse row of needles.

2. The invention according to claim 1 in which said rear needle gauge is equal to twice said front needle gauge, said transverse spacing between said adjacent finger members containing the vertical reciprocable paths of a pair of front needles between each pair of adjacent finger members.

3. The invention according to claim 2 in which the needle path of each rear needle lies closely adjacent a corresponding finger member and is spaced ore remotely from a finger member on the opposite side of said needle path.

4. The invention according to claim 3 in which each of said rear needle paths lies between a pair of first and second opposed finger members and adjacent said first finger member, said rear needle path being spaced from said second finger member a distance equal to at least the transverse dimension of a rear needle.

5. The invention according to claim 4 in which each of said rear needles is offset transversely relative to said front needles to constitute staggered needles, each of said finger members having a substantially straight elongated shank portion extending between alternate pairs of said front needle paths and having a rear portion offset from said shank portion extending between said corresponding rear needle paths.

6. The invention according to claim 5 in which said shank portion is substantially straight and said rear offset portion diverges from the longitudinal axis of said shank portion.

7. The invention according to claim 2 in which said rear needle gauge is equal to said front needle gauge, said finger members extending between alternate pairs of rear needle paths in said rear transverse row.

8. The invention according to claim 1 further comprising a front transverse needle bar supporting said front needles and a rear transverse needle bar supporting said rear needles, means for transversely shifting at least one of said needle bars, and means for vertically reciprocating said needle bars.

9. The invention according to claim 2 further comprising a plurality of notches in said free edge portion, there being one notch for each front needle and two notches between each pair of finger members, each of said notches being longitudinally aligned with the needle path of a corresponding front needle for partially receiving said front needle as it reciprocates between said finger members.

* * * * *